US006866467B2

(12) United States Patent
Dvorak et al.

(10) Patent No.: US 6,866,467 B2
(45) Date of Patent: Mar. 15, 2005

(54) HYDRAULICALLY ACTUATED QUICK COUPLING DEVICE

(75) Inventors: Paul A. Dvorak, Sanford, NC (US); Gabriel G. Khairallah, Carrboro, NC (US); Chin T. Khaw, Apex, NC (US); Truett R. Thompson, Raleigh, NC (US)

(73) Assignee: Caterpillar S.A.R.L., Geneva ( * ) Notice: Subject to any disclaimer, the term of this patent is extended or adjusted under 35 U.S.C. 154(b) by 0 days.

(21) Appl. No.: 09/726,078

(22) Filed: Nov. 29, 2000

(65) Prior Publication Data

US 2002/0064446 A1 May 30, 2002

(51) Int. Cl.[7] ..... E02F 3/28
(52) U.S. Cl. ..... 414/723; 37/468
(58) Field of Search ..... 414/723; 37/468; 403/321, 322.3, 322.4

(56) References Cited

U.S. PATENT DOCUMENTS

| | | | | |
|---|---|---|---|---|
| 3,269,570 A | * | 8/1966 | Wallberg | 414/723 |
| 3,672,521 A | | 6/1972 | Bauer et al. | |
| 3,732,996 A | | 5/1973 | Bauer | |
| 4,417,844 A | | 11/1983 | de Pingon | |
| 4,439,938 A | | 4/1984 | Grant | |
| 4,509,768 A | | 4/1985 | Haug | |
| 4,554,978 A | | 11/1985 | Schneider | |
| 4,643,631 A | | 2/1987 | Maurer et al. | |
| 4,661,036 A | | 4/1987 | Horsch | |
| 4,663,866 A | | 5/1987 | Karlsson et al. | |
| 4,708,579 A | | 11/1987 | Baird et al. | |
| 4,717,166 A | | 1/1988 | Vachon | |
| 4,720,234 A | | 1/1988 | Stralow | |
| 4,726,731 A | | 2/1988 | Jones | |
| 4,787,811 A | | 11/1988 | Langenfeld et al. | |
| 4,812,103 A | | 3/1989 | Cochran et al. | |
| 4,845,867 A | | 7/1989 | Albrecht | |
| 5,098,252 A | | 3/1992 | Sheesley et al. | |
| 5,145,333 A | | 9/1992 | Smith | |
| 5,465,513 A | | 11/1995 | Sonerud | |
| 5,467,542 A | | 11/1995 | Hulden | |
| 5,484,250 A | | 1/1996 | Gilmore et al. | |
| 5,487,230 A | | 1/1996 | Weyer | |
| 5,494,396 A | | 2/1996 | Geier et al. | |
| 5,546,683 A | | 8/1996 | Clark | |
| 5,562,397 A | | 10/1996 | Albright | |
| 5,575,093 A | | 11/1996 | Pratt et al. | |
| 5,581,917 A | | 12/1996 | Barden | |
| 5,597,283 A | | 1/1997 | Jones | |
| 5,674,046 A | | 10/1997 | Meyer | |
| 5,692,325 A | | 12/1997 | Kuzutani | |
| 5,727,342 A | | 3/1998 | Horton | |
| 5,732,488 A | | 3/1998 | Smith | |
| 5,820,332 A | | 10/1998 | Philips et al. | |
| 5,865,594 A | | 2/1999 | Kim | |
| 5,890,871 A | | 4/1999 | Woerman | |
| 5,915,837 A | | 6/1999 | Brown et al. | |

(List continued on next page.)

*Primary Examiner*—Donald W. Underwood
(74) *Attorney, Agent, or Firm*—Diana L Charlton

(57) ABSTRACT

An attachment frame is connected with a loader arm of a work machine for connecting an implement thereto. A latch member is operatively associated with the attachment frame and movable between a disengaged position and an engaged position. A link has a first end portion connected to the latch member and a second end portion. A pivot member has a first end portion pivotally connected on the attachment frame, a second end portion pivotally connected on the second end portion of the link, and a central portion. A cylinder has a head end portion connected to the attachment frame and a rod end portion connected to the central portion of the pivot member. The cylinder is connected with a supply of hydraulic fluid so that upon pressurization thereof the cylinder is actuated for moving the latch member between the disengaged and engaged positions to respectively detach and attach the implement to the work machine.

27 Claims, 6 Drawing Sheets

U.S. PATENT DOCUMENTS 5,966,850 A * 10/1999 Horton ..... 414/723 X
5,967,738 A 10/1999 Warthold
5,974,706 A 11/1999 Kaczmarski et al.
5,983,535 A 11/1999 Kaczmarski et al.
6,000,154 A 12/1999 Bernard et al.
6,035,944 A 3/2000 Neuner et al.
6,238,130 B1 * 5/2001 Youngers ..... 37/468 X
6,332,748 B1 * 12/2001 Doering et al. ..... 414/723

* cited by examiner

HYDRAULICALLY ACTUATED QUICK COUPLING DEVICE

TECHNICAL FIELD

This invention relates generally to a quick coupling device for a skid steer loader machine and, more particularly, to hydraulically actuating the quick coupling device to achieve power operation in a compact design.

BACKGROUND ART

Quick coupling devices are generally carried on the front of a loader arm and are used for quickly attaching and detaching various implements, such as buckets and the like. Some of these quick coupling devices may also be power-operated to reduce the necessity for manual intervention and to ease operation.

One such example is disclosed in U.S. Pat. No. 5,562,397 issued on Oct. 8, 1996 to Larry E. Albright. In this patent, a power operator is used with a quick attachment device on front end loaders. The power operator operates on existing manual levers unlocked positions to either lock in place or release a loader attachment to the attachment frame. The actuator directly connects to pivoting portions of the manual levers and causes the levers to be moved under power between the locked and unlocked positions. However, the use of the actuator on existing manual levers limits the flexibility of the power actuator and may increase risks associated with "pinch-points" created by the manual levers. Further, the use of only one power actuator across the length of the quick attachment device may hamper access to the front end loader and increase the possibility of damage to the power actuator during such access. Additionally, because the power actuator applies a horizontal force to the manual levers, a percentage of the power is lost in moving the locking mechanisms in a vertical direction.

The present invention is directed to overcoming one or more of the problems as set forth above.

DISCLOSURE OF THE INVENTION

In one aspect of the present invention, a hydraulically actuated quick coupling device comprises an attachment frame including a centerline. A latch member is operatively associated with the attachment frame and movable between a disengaged position and an engaged position. A link has first and second end portions with the first end portion of the link connected to the latch member. A pivot member has first and second end portions and a central portion with the first end portion pivotally connected on the attachment frame and the second end portion pivotally connected on the second end portion of the link. A cylinder has head and rod end portions with the head end portion connected to the attachment frame and the rod end portion connected to the central portion of the pivot member. The cylinder is operable for moving the latch member between the disengaged and engaged positions.

In another aspect of the present invention, a work machine has a frame, a loader arm connected to the frame and extends forwardly therefrom, and an implement. The work machine comprises an attachment frame with a centerline connectable to the loader arm. A latch member is operatively associated with the attachment frame and movable between a disengaged position and an engaged position. A link has first and second end portions with the first end portion of the link connected to the latch member. A pivot member has first and second end portions and a central portion with the first end portion pivotally connected on the attachment frame and the second end portion pivotally connected on the second end portion of the link. A supply of hydraulic fluid is included with a circuit for pressurizing the hydraulic fluid. A cylinder has head and rod end portions with the head end portion connected to the attachment frame and the rod end portion connected to the central portion of the pivot member. The cylinder is connected with the supply of hydraulic fluid so that upon pressurization thereof the cylinder is actuated for moving the latch member between the disengaged and engaged positions to respectively detach and attach the implement to the work machine.

The present invention utilizes a pivot member between a cylinder and a link that is forced by the actuation of the cylinder to act upon the link to move a latch member between a disengaged position and an engaged position. The interconnection and functional relationship of these components provides a compact coupling device for hydraulically detaching and attaching an implement to a work machine.

BRIEF DESCRIPTION OF THE DRAWINGS

FIG. 6 is a hydraulic schematic disclosing another embodiment of the circuit for the present invention.

BEST MODE FOR CARRYING OUT THE INVENTION

Figure 1:
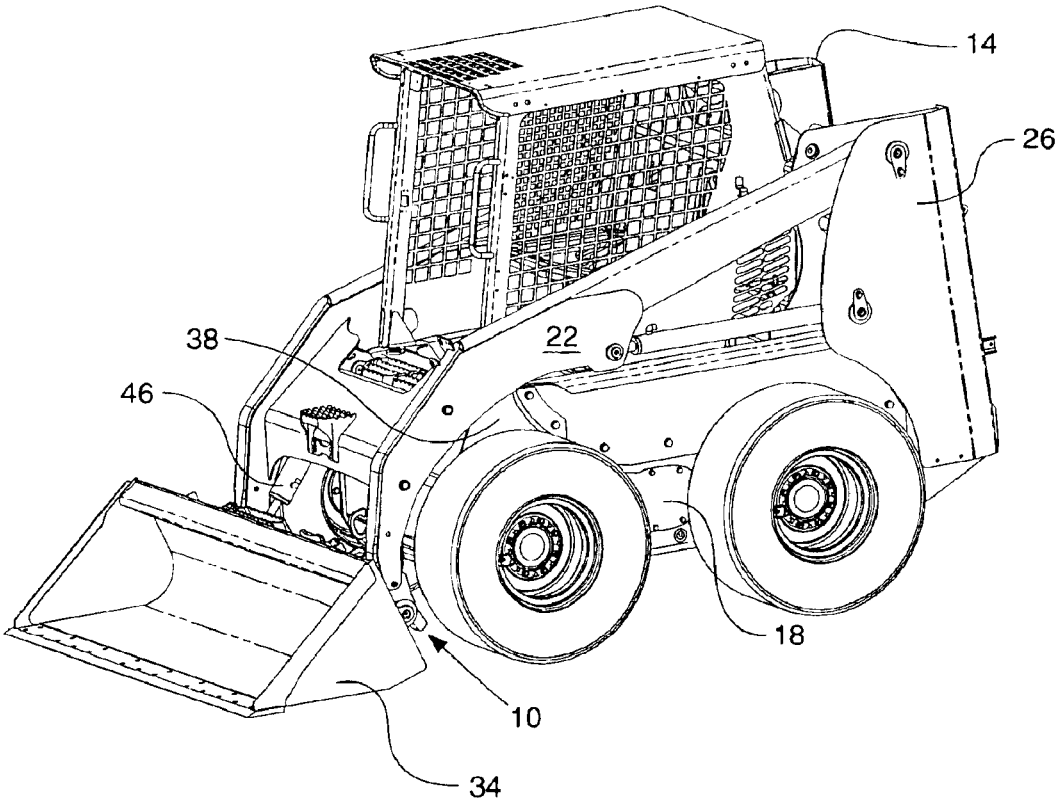
FIG. 1 is a perspective view of a work machine incorporating the present invention quick coupling device.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

With reference to FIG. 1, the present invention incorporates a quick coupling device 10 adapted for use on a work machine 14, such as a skid steer loader. The work machine 14 has a frame 18, a pair of spaced loader arms, one of which is shown at 22, connected at a first end to a rear portion 26 of the work machine 14, and an implement 34 disposed at a front portion 38 of the work machine 14 in connection with a second end of the loader arms 22.

Figure 3:
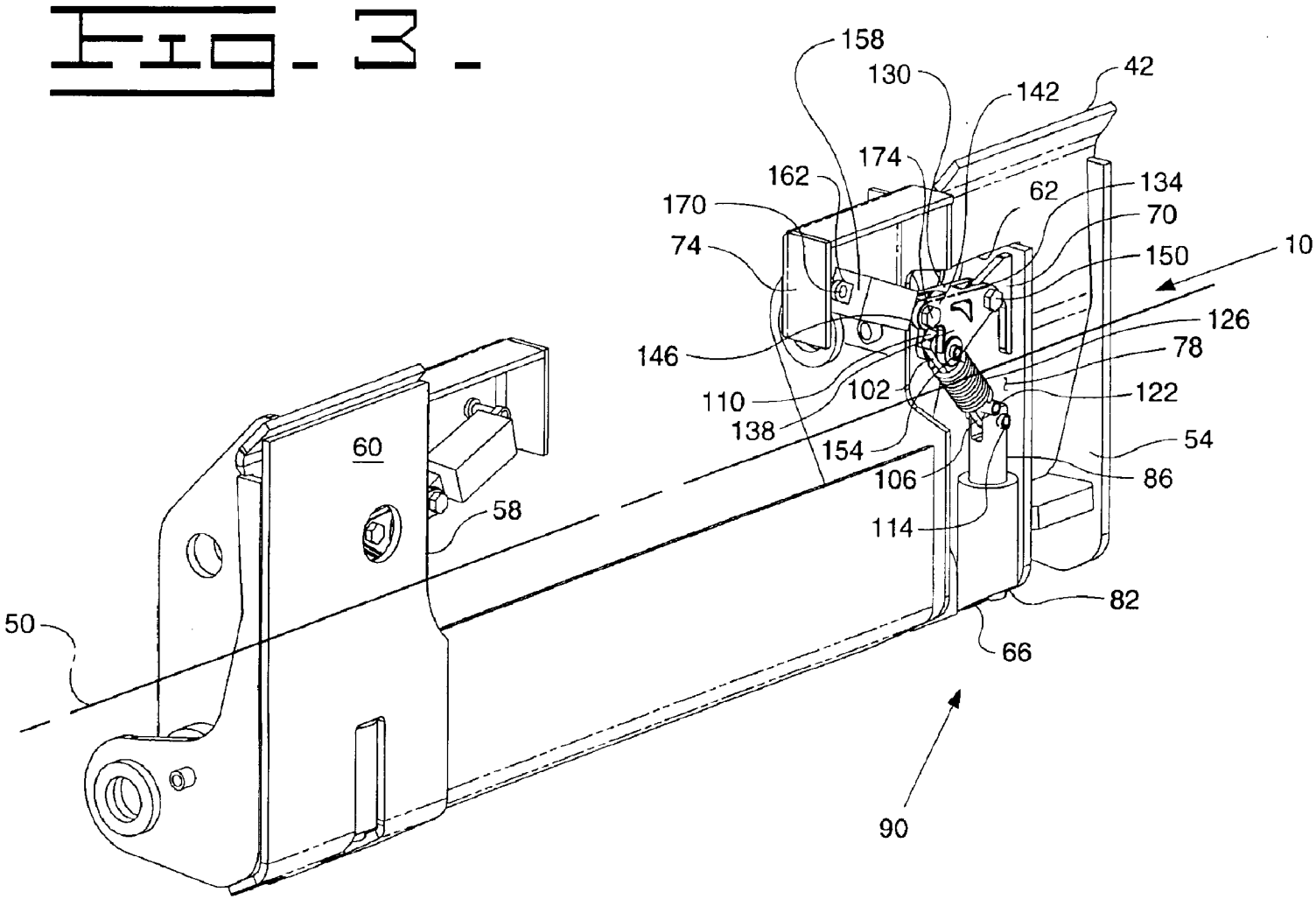
FIG. 3 is a perspective view of a latching member for the present invention shown in a disengaged position.
Figure 4:
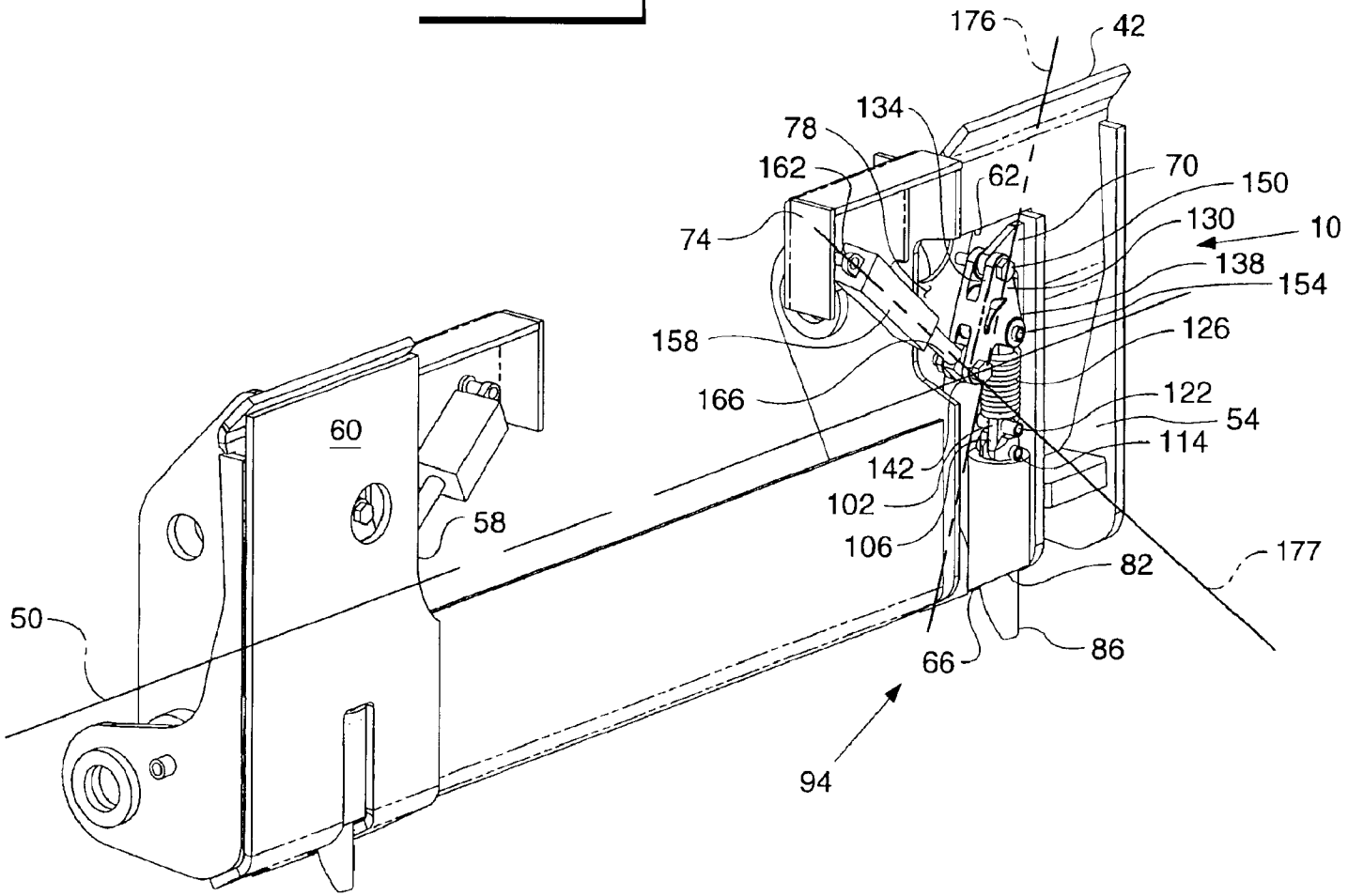
FIG. 4 is a perspective view of the latching member for the present invention shown in an engaged position.
Figure 5:
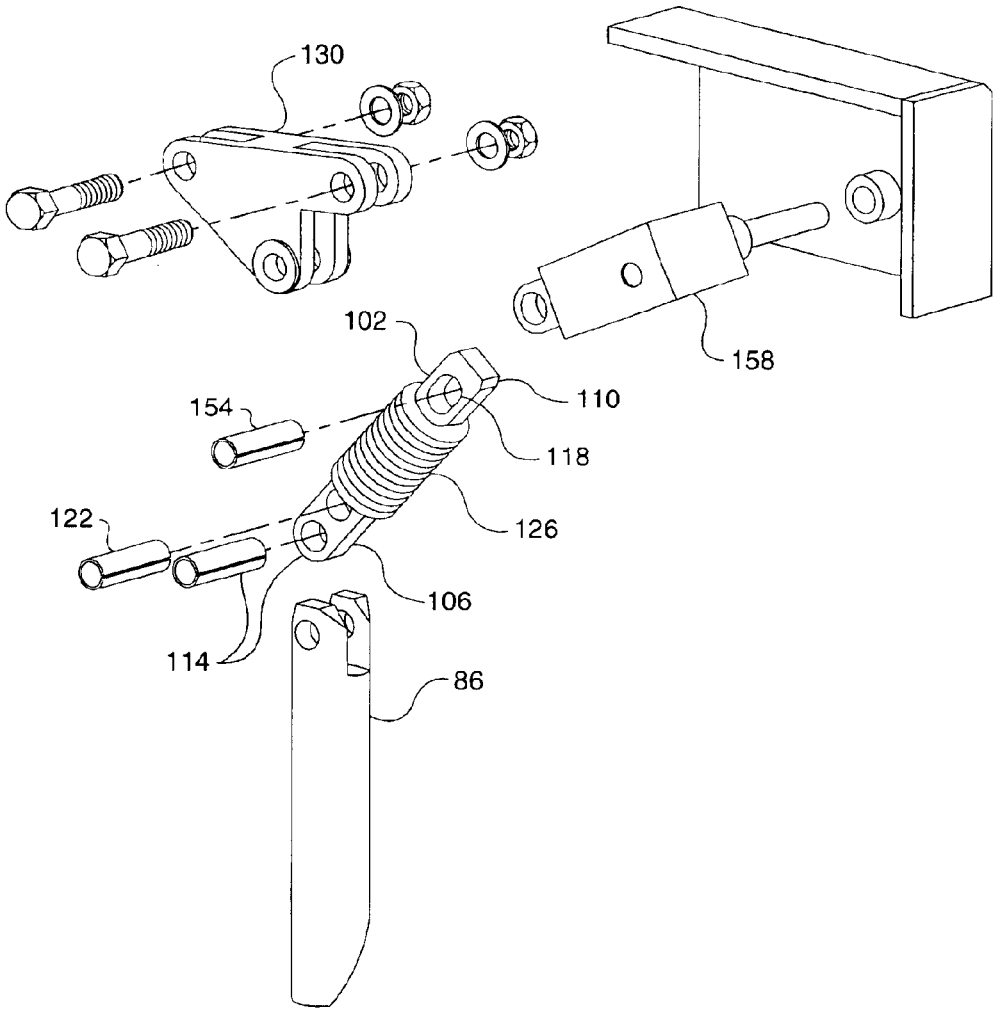
FIG. 5 is an exploded view of the major components of the present invention.
Figure 5:
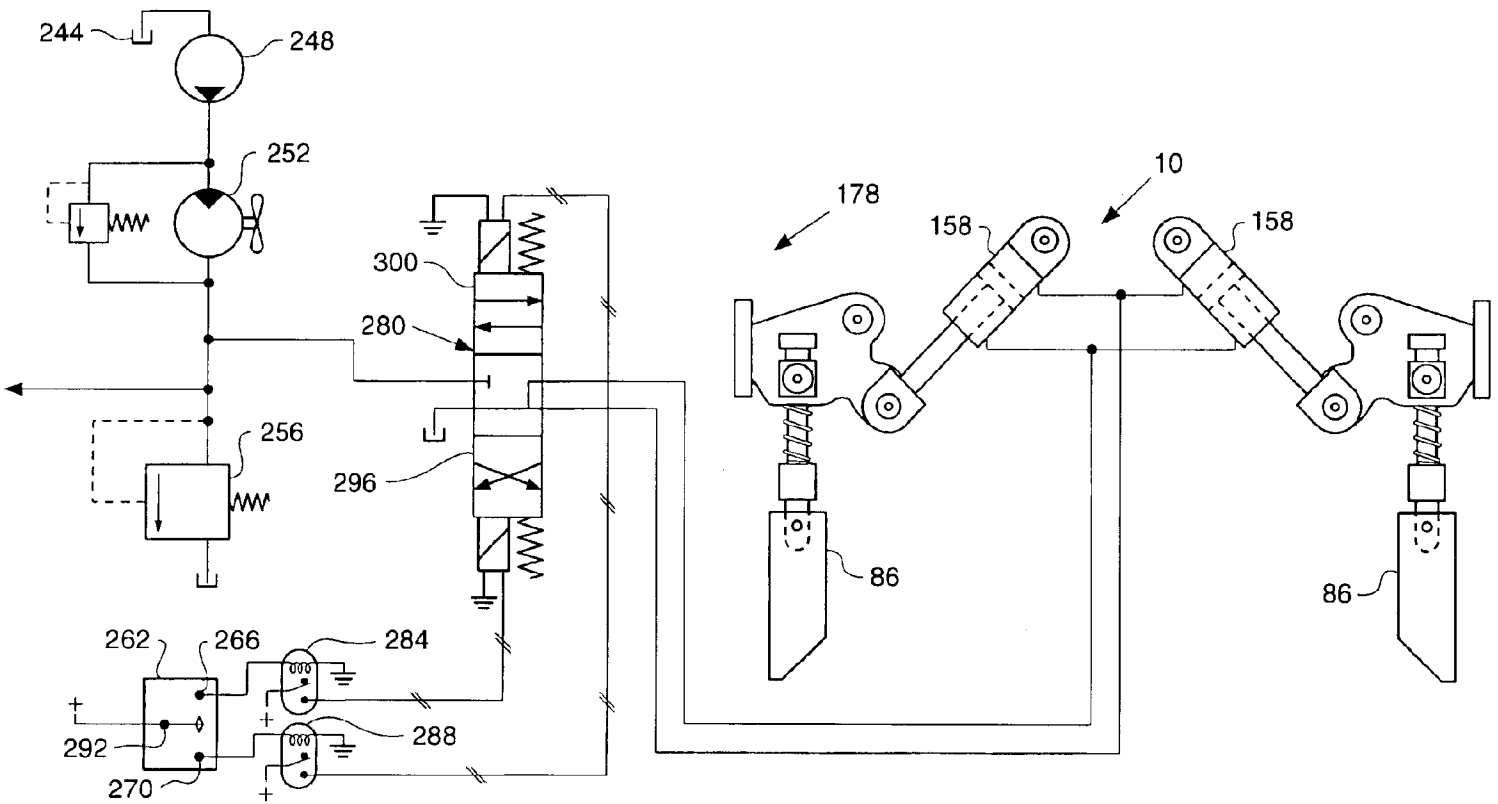

Referring more particularly to FIGS. 3–5, the quick coupling device 10 includes an attachment frame 42 for connecting the implement 34 to the work machine 14. A pair of tilt cylinders, one of which is shown at 46 (seen in FIG. 1), are connected at one end to the frame 18 of the work machine 14 and at an opposite end to the attachment frame 42 for controlling the tiltable movement of the implement 34. The attachment frame 42 has a centerline 50 extending therethrough and includes a pair of spaced housing assemblies 54,58 that are partially enclosed by a cover plate 60. Only one of the pair of housing assemblies 54 will be described in detail to improve clarity and is shown in FIGS. 3 & 4 with the cover plate removed. It should be understood, however, that the other of the pair of housing assemblies 58 includes identical features of that one housing assembly 54.

The housing assembly 54 includes top and bottom walls 62,66, respectively. A pair of mounting brackets 70,74 are connected in any suitable manner with the housing assembly 54. A partial chamber 78 is defined in a portion of the housing assembly 54 extending between the top and bottom walls 62,66. An aperture 82 is defined through a portion of the bottom wall 66 located within the chamber 78. The aperture 82 is adapted to align with an aperture (not shown) in the implement 34 upon connection.

A latch member 86 is slidingly disposed within the aperture 82 in the attachment frame 42 and is movable between a disengaged position 90 (FIG. 3) and an engaged position 94 (FIG. 4). The latch member 86 is positioned substantially vertically at a central portion of the bottom wall 66 and disposed approximately ninety degrees from the centerline 50 of the attachment frame 42. A link 102 has first and second end portions 106,110 with the first end portion 106 pivotally connected to the latch member 86 at a pin joint 114. The second end portion 110 of the link 102 includes a slot 118 therethrough (seen only in FIG. 5). A pin 122 extends through the link 102 between the first and second end portions 106,110 and projects outwardly to define a compressing member. A spring 126 circumferentially surrounds the link 102 between the second end portion 110 and the pin 122. The link 102 is disposed approximately at a forty-five degree angle from the centerline 50 of the attachment frame 42 and is angularly positioned in relation to the latch member 86 when the latch member 86 is in the disengaged position 90. The link 102 is disposed approximately at a ninety degree angle from the centerline 50 of the attachment frame and is substantially aligned with the latch member 86 when the latch member 86 is in the engaged position 94. A pivot member 130 has first and second end portions 134,138 and a central portion 142 with a tab 146 extending therefrom. The first end portion 134 of the pivot member 130 is pivotally connected by pin 150 to the mounting bracket 70 on the attachment frame 42. The second end portion 138 is pivotally connected by pin 154 within the slot 118 at the second end portion 110 of the link 102. A hydraulic cylinder 158 has a head end portion 162 and an extendible rod end portion 166. The head end portion 162 is connected by pin 170 to the bracket 74 of the attachment frame 42. The rod end portion 166 is fixedly connected at pin 174 to the tab 146 at the central portion 142 of the pivot member 130. The hydraulic cylinder 158 is disposed angularly from the centerline 50 of the attachment frame 42 and the latch member 86 when the latch member 86 is in either the disengaged or engaged 90,94 position. Referring more specifically to FIG. 4, a line 176 is defined through pins 150 & 174 and a line 177 is defined through pins 170 & 174 to form a substantial ninety degree angle therebetween.

Figure 2:
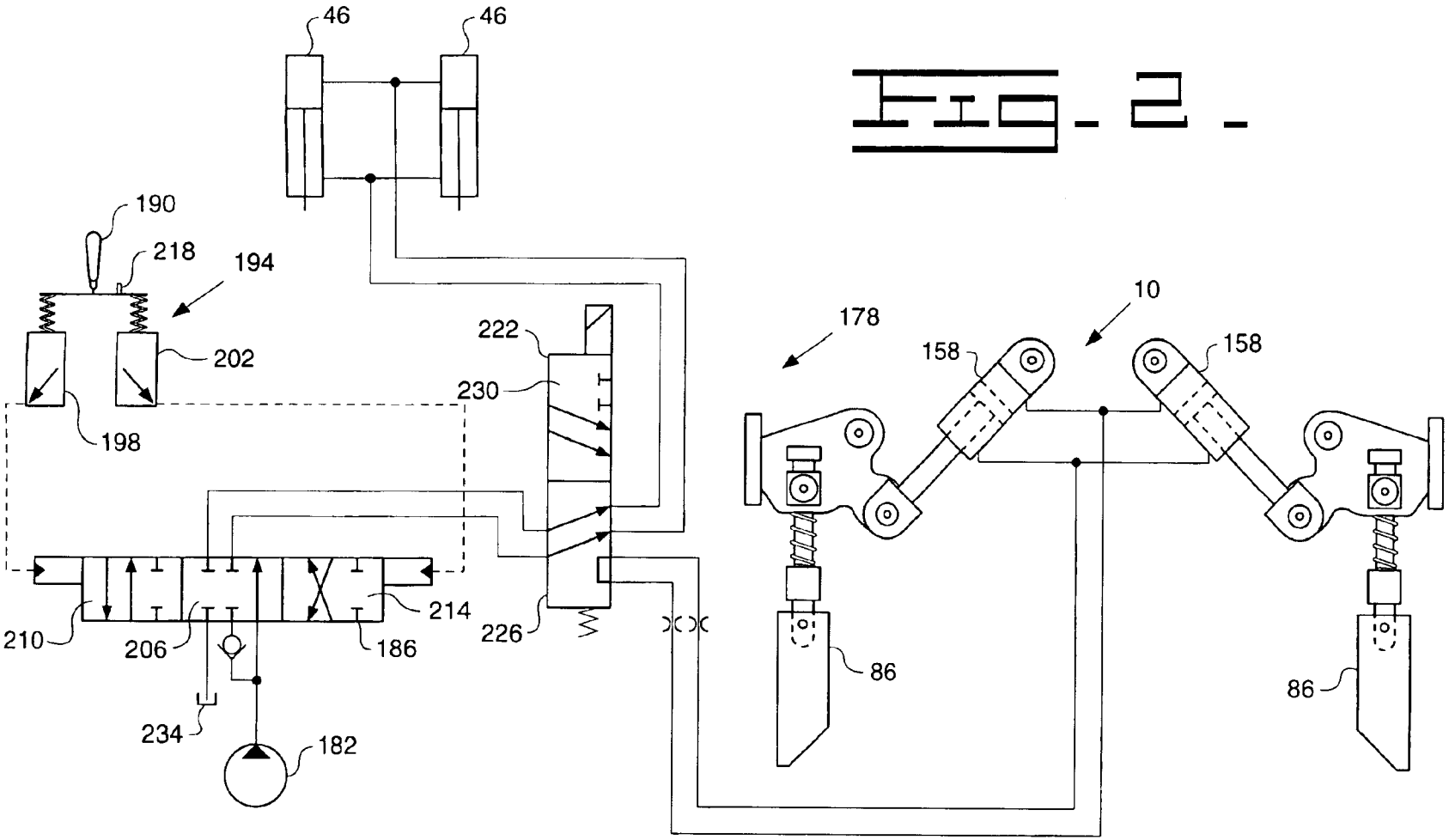
FIG. 2 is a hydraulic schematic disclosing the circuit for the present invention.

Referring more particularly to FIG. 2, the hydraulic cylinders 158 are actuated through the use of a hydraulic circuit 178 for moving the latch member 86 between the disengaged and engaged positions 90,94 (seen in FIGS. 3 & 4). It should be understood that, although hydraulic cylinders 158 and circuit 178 are disclosed, any suitable type of cylinder or circuit may be used to move the latch member 86. The hydraulic circuit 178 utilizes a supply of hydraulic fluid from a tank (not shown). A pump 182 is used to pressurize the hydraulic fluid. A spool valve 186 is connected in line with the pump 182 and is of a well-known design operable via a control lever 190 connected therewith. The spool valve 186 moves between three positions for directing the hydraulic fluid through the hydraulic circuit 178. The control lever 190 includes an electrical switch 194 movable between two positions 198,202 for energizing the spool valve 186 from a normally spring centered locked position 206 to a respective first operative position 210 or a second operative position 214. The switch 194 includes an electrical override switch 218 connected with the one position 202 related to the respective second operative position 214 of the spool valve 186. A diverter valve 222 is connected in line with the spool valve 186. The diverter valve 222 is movable between an implement position 226 for directing hydraulic fluid to the tilt cylinders 46 and a coupling position 230 for directing hydraulic fluid to the cylinder 158 in the quick coupling device 10 when the spool valve 186 is in the operative position 210. A drain 234 is provided for relieving the pressure in the hydraulic fluid when the spool valve 186 is in either the first or second operative position 210,214.

An alternate embodiment hydraulic circuit 240 is shown in FIG. 6 that actuates the hydraulic cylinders 158 for moving the latch member 86 between the disengaged and engaged positions 90,94 (seen in FIGS. 3 & 4). It should be understood that the same reference numbers will be used in FIG. 6 to describe identical elements shown in FIG. 2.

The hydraulic circuit 240 utilizes a supply of hydraulic fluid from a tank 244. A pump 248 is used to pressurize the hydraulic fluid through a motor 252 and to charge a downline pump system (not shown). A charge relief 256 is used in the hydraulic circuit 240 in a well known manner. A dedicated electrical switch 262 is used in conjunction with the hydraulic circuit 240 and is movable between two positions 266,270 for energizing a diverter valve 280 through a pair of relays 284,288, respectively. The electrical switch 262 includes a normally spring centered neutral position 292. The diverter valve 280 is connected in line with the pump 248 and motor 252 to utilize charge flow within the hydraulic circuit 240. The diverter valve 280 is movable between a locked position 296 for directing hydraulic fluid to the cylinders 158 when the electrical switch 262 is in position 266 and an unlocked position 300 for directing hydraulic fluid to the cylinders 158 when the electrical switch 262 is in position 270.

INDUSTRIAL APPLICABILITY

Under actual operating conditions, an operator (not shown) would normally have the diverter valve 222 set to the implement position 226 via any suitable control device (not shown). In the implement position 226, the operator (not shown) may move the control lever 190 to one of the positions 198 to electrically energize the spool valve 186 to the first operative position 210. The first operative position 210 allows a flow of pressurized hydraulic fluid to move from the pump 182 to one side of the tilt cylinders 46 through the spool and diverter valves 186,222 to extend the tilt cylinders 46. The spool valve 186 is spring centered to the locked position 206 in order to hold the tilt cylinder in the extended position. Next, the operator (not shown) may move the control lever 190 to the other of the positions 202 to electrically energize the spool valve 186 to the second operative position 214. To ensure that the operator (not shown) intends to move the control lever 190 in such a manner, the override switch 218 must also be energized simultaneously with the control lever 190. The second operative position 214 allows a flow of pressurized hydraulic fluid to move from the pump 182 to an opposite side of the tilt cylinders 46 through the spool and diverter valves 186,222 to retract the tilt cylinders 46.

In order to operate the quick coupling device 10, the operator (not shown) must move the diverter valve 222 from the implement position 226 to the coupling position 230 utilizing the control device (not shown). Once in the coupling position 230, the operator (not shown) may move the control lever 190 to one of the positions 198 to electrically energize the spool valve 186 to the first operative position 210. The first operative position 210 allows a flow of pressurized hydraulic fluid to move from the pump 182 to one side of the cylinder 158 through the spool and diverter valves 186,222 for extending the cylinder 158 and engaging the latch member 86. The spool valve 186 is spring centered to the locked position 206 in order to hold the latch member 86 in the engaged position 94. Next, in order to disengage the latch member 86, the operator (not shown) may move the control lever 190 to the other one of the positions 202 to electrically energize the spool valve 186 to the second operative position 214. To ensure that the operator (not shown) intends to move the control lever 190 in such a manner, the override switch 218 must also be energized simultaneously with the control lever 190. The second operative position 214 allows a flow of pressurized hydraulic fluid to move from the pump 182 to an opposite side of the cylinder 158 through the spool and diverter valves 186,222 for retracting the cylinder 158 and disengaging the latch member 86. It should be understood that although the extension of the tilt cylinders 46 and the hydraulic cylinders 158 may not be completed simultaneously, both functions are available when the diverter valve 222 is set at the appropriate position, 226 or 230, respectively.

In the alternate embodiment of FIG. 6, the operator (not shown) moves the electrical switch 262 to one of the positions 266 to electrically energize the diverter valve 280 to the locked position 296. The locked 296 allows a flow of pressurized hydraulic fluid to move from the pump 248 to one side of the cylinder 158 for extending the cylinder 158 and engaging the latch member 86. The electrical switch 262 is spring centered to the neutral position 292 in order to hold the latch member 86 in the engaged position 94. Next, in order to disengage the latch member 86, the operator (not shown) moves the electrical switch 262 to the other one of the positions 270 to electrically energize the diverter valve 280 to the unlocked position 300. The unlocked position 300 allows a flow of pressurized hydraulic fluid to move from the pump 248 to an opposite side of the cylinder 158 for retracting the cylinder 158 and disengaging the latch member 86. The electrical switch 262 is spring centered to the neutral position 292 in order to hold the latch member 86 in the disengaged position 90. The ability to divert an amount of fluid from the hydraulic circuit 240 in such a manner is simple and requires few components so that actuation of the hydraulic cylinders 158 is quick and efficient without the need for additional hydraulic circuits.

Other aspects, objects, and features of the present invention can be obtained from a study of the drawings, the disclosure, and the appended claims.

What is claimed is:

1. A hydraulically actuated quick coupling device, comprising:

an attachment frame including a centerline;

a latch member operatively associated with the attachment frame and movable between a disengaged position and an engaged position;

a link being non-integral with the latch member and having first and second end portions, the first end portion of the link being connected to the latch member;

a pivot member having spaced first, second, and third contact positions located thereon, the first contact position being used to pivotally connect the pivot member to the attachment frame and the second contact position being used to pivotally connect the pivot member to the second end portion of the link; and a cylinder having head and rod end portions, the head end portion being connected to the attachment frame and the rod end portion being connected at the third contact position on the pivot member, the cylinder being operable for moving the latch member substantially vertically between the disengaged and engaged positions.

2. The hydraulically actuated quick coupling device of claim 1, wherein when the latch member is in the engaged position the connection between the pivot member and the attachment frame defines a first position and the connection between the pivot member and the cylinder defines a second position and the connection between the cylinder and the attachment frame defines a third position, the first and second position define a first line therethrough and the second and third position define a second line therethrough with the second line being positioned substantially at a ninety degree angle from the first line.

3. The hydraulically actuated quick coupling device of claim 1, including a supply of hydraulic fluid and a circuit for pressurizing the hydraulic fluid wherein the cylinder is connected with the supply of hydraulic fluid so that upon pressurization thereof the cylinder is actuated for moving the latch member.

4. The hydraulically actuated quick coupling device of claim 1, wherein each of the cylinder and link are angularly positioned in relation to the centerline of the attachment frame.

5. The hydraulically actuated quick coupling device of claim 4, wherein the angular position of the cylinder and link are each less than ninety degrees when the latch member is in the disengaged position.

6. The hydraulically actuated quick coupling device of claim 4, wherein the angular position of the cylinder is less than ninety degrees and the link is approximately ninety degrees when the latch member is in the engaged position.

7. The hydraulically actuated quick coupling device of claim 1, wherein the latch member is slidingly disposed within the attachment frame and is angular positioned approximately ninety degrees from the centerline of the attachment frame.

8. The hydraulically actuated quick coupling device of claim 1, wherein the second end portion of the link defines a slot therethrough in which the second end portion of the pivot member is connected to allow for transitional movement therein.

9. The hydraulically actuated quick coupling device of claim 3, wherein the circuit includes a means for diverting the supply of hydraulic fluid from a portion of the circuit to the cylinder.

10. The hydraulically actuated quick coupling device of claim 9, wherein the portion of the circuit from which the supply of hydraulic fluid is diverted controls a function other than the actuation of the cylinder.

11. The hydraulically actuated quick coupling device of claim 3, including:

a second latch member operatively associated with the attachment frame and spaced from the first latch member, the second latch member being movable between a disengaged position and an engaged position;

a second link having first and second end portions and being spaced from the first link, the first end portion of the second link being connected to the second latch member;

a second pivot member spaced from the first pivot member and having first and second end portions and a central portion, the first end portion of the second pivot member pivotally connected on the attachment frame and the second end portion of the second pivot member pivotally connected on the second end portion of the second link; and a second cylinder having head and rod end portions, the head end portion of the second cylinder being connected to the attachment frame and the rod end portion of the second cylinder being connected to the central portion of the second pivot member, the second cylinder being connected with the supply of hydraulic fluid so that upon pressurization thereof the second cylinder is actuated for moving the second latch member between the disengaged and engaged positions.

12. The hydraulically actuated quick coupling device of claim 11, wherein the actuation of the first and second cylinders is contemporaneous.

13. The hydraulically actuated quick coupling device of claim 12, wherein each of the second cylinder and link are angularly positioned in relation to the centerline of the attachment frame.

14. The hydraulically actuated quick coupling device of claim 13, wherein the angular position of the second cylinder and link are each less than ninety degrees.

15. The hydraulically actuated quick coupling device of claim 13, wherein the angular position of the second cylinder is less than ninety degrees and the second link is approximately ninety degrees when the latch member is in the engaged position.

16. The hydraulically actuated quick coupling device of claim 11, wherein the circuit includes a means for diverting the supply of hydraulic fluid from a portion of the circuit to the first and second cylinders.

17. The hydraulically actuated quick coupling device of claim 16, wherein the portion of the circuit from which the supply of hydraulic fluid is diverted controls a function other than the actuation of the cylinder.

18. The hydraulically actuated quick coupling device of claim 11, wherein the first and second latch members are slidingly disposed within the attachment frame and each are angular positioned substantially ninety degrees from the centerline of the attachment frame.

19. A work machine having a frame, a loader arm connected to the frame and extending forwardly therefrom, and an implement, the work machine comprising:

an attachment frame having a centerline and being connectable to the loader arm;

a latch member operatively associated with the attachment frame and movable between a disengaged position and an engaged position;

a link being non-integral with the latch member and having first and second end portions, the first end portion of the link being connected to the latch member;

a pivot member having spaced first, second, and third contact positions located thereon, the first contact position being used to pivotally connect the pivot member to the attachment frame and the second contact position being used to pivotally connect the pivot member to the second end portion of the link;

a supply of hydraulic fluid;

a circuit for pressurizing the hydraulic fluid; and a cylinder having head and rod end portions, the head end portion being connected to the attachment frame and the rod end portion being connected at the third contact position on the pivot member, the cylinder being connected with the supply of hydraulic fluid so that upon pressurization thereof the cylinder is actuated for moving the latch member substantially vertically between the disengaged and engaged positions to respectively detach and attach the implement to the work machine.

20. The work machine of claim 19, including:

a second latch member operatively associated with the attachment frame and spaced from the first latch member, the second latch member being movable between a disengaged position and an engaged position;

a second link having first and second end portions spaced from the first link, the first end portion of the second link being connected to the second latch member;

a second pivot member spaced from the first pivot member and having first and second end portions and a central portion, the first end portion of the second pivot member pivotally connected on the attachment frame and the second end portion of the second pivot member pivotally connected on the second end portion of the second link; and a second cylinder having head and rod end portions, the head end portion of the second cylinder being connected to the attachment frame and the rod end portion of the second cylinder being connected to the central portion of the second pivot member, the second cylinder being connected with the supply of hydraulic fluid so that upon pressurization thereof the second cylinder is actuated for moving the second latch member between the disengaged and engaged positions.

21. The work machine claim 20, wherein the actuation of the first and second cylinders is contemporaneous.

22. The work machine of claim 21, wherein each of the first and second cylinder and link are angularly positioned in relation to the centerline of the attachment frame.

23. The work machine of claim 22, wherein the angular position of the first and second cylinder and link are each less than ninety degrees when the latch member is in the disengaged position.

24. The work machine of claim 22, wherein the angular position of the first and second cylinder is less than ninety degrees and the first and second link is approximately ninety degrees when the latch member is in the engaged position.

25. The work machine of claim 19, wherein the circuit includes a means for diverting the supply of hydraulic fluid from a portion of the circuit to the first and second cylinders.

26. The work machine of claim 25, wherein the portion of the circuit from which the supply of hydraulic fluid is diverted controls a function other than the actuation of the cylinder.

27. The work machine of claim 19, wherein the first and second latch members are slidingly disposed within the attachment frame and each are angular positioned substantially ninety degrees from the centerline of the attachment frame.

* * * * *